US009247817B2

(12) United States Patent
Grace

(10) Patent No.: US 9,247,817 B2
(45) Date of Patent: Feb. 2, 2016

(54) PORTABLE, COLLAPSIBLE STADIUM SEAT

(71) Applicant: Daniel R. Grace, Old Saybrook, CT (US)

(72) Inventor: Daniel R. Grace, Old Saybrook, CT (US)

(73) Assignee: Rio Brands, LLC, West Conshohocken, PA (US)

( * ) Notice: Subject to any disclaimer, the term of this patent is extended or adjusted under 35 U.S.C. 154(b) by 0 days.

(21) Appl. No.: 13/790,893

(22) Filed: Mar. 8, 2013

(65) Prior Publication Data

US 2013/0257128 A1 Oct. 3, 2013

Related U.S. Application Data

(60) Provisional application No. 61/608,914, filed on Mar. 9, 2012.

(51) Int. Cl.
*A47C 1/16* (2006.01)
*A47C 4/04* (2006.01)

(52) U.S. Cl.
CPC .... *A47C 4/04* (2013.01); *A47C 1/16* (2013.01)

(58) Field of Classification Search
CPC ..... A47C 1/146; A47C 1/16; A47C 4/52; A47C 9/10
USPC ..... 297/42, 44, 45, 250.1, 284.3, 312, 340, 297/378.1, 411.3
See application file for complete search history.

(56) References Cited

U.S. PATENT DOCUMENTS

| | | | | |
|---|---|---|---|---|
| 1,963,835 | A * | 6/1934 | Deland | 297/44 |
| 4,824,171 | A * | 4/1989 | Hollingsworth | 297/351 |
| 4,826,241 | A * | 5/1989 | Barras | 297/16.2 |
| 4,890,882 | A * | 1/1990 | Harrington | A47C 4/52 297/17 |
| 5,244,250 | A * | 9/1993 | Nordmeyer | 297/59 |
| 7,631,934 | B2 * | 12/2009 | Mac Isaac | A47C 4/283 297/217.7 |
| 7,641,276 | B1 * | 1/2010 | Chen | 297/42 |
| 2006/0163922 | A1 * | 7/2006 | Flannery | 297/250.1 |
| 2008/0122268 | A1 * | 5/2008 | Kim | 297/16.2 |
| 2009/0256401 | A1 * | 10/2009 | Hensley | A47C 4/52 297/17 |
| 2011/0018312 | A1 * | 1/2011 | Grace | 297/16.2 |

* cited by examiner

*Primary Examiner* — Philip Gabler
(74) *Attorney, Agent, or Firm* — McCormick, Paulding & Huber LLP

(57) ABSTRACT

A collapsible seat includes a seat bottom, a back support, and armrests, all interconnected for movement between an operative, or set-up, condition and a collapsed, or bundled, condition. The seat bottom comprises first and second portions interconnected together and foldable into generally parallel relationship with one another associated with the collapsed condition of the seat. The back support is pivotally disposed relative to the seat bottom such that, in the seat's set-up condition, the back support extends generally upwardly from a rear portion of the seat bottom and is capable of pivotal movement relative to the seat bottom for collapsing the seat to its collapsed condition. The armrests are located on the outer edges of the seat bottom when the seat is in its set-up condition, and are pivotally connected with the first and second seat bottom portions, respectively, for movement relative thereto during set-up and collapsing of the seat.

20 Claims, 10 Drawing Sheets

PORTABLE, COLLAPSIBLE STADIUM SEAT

CROSS-REFERENCE TO RELATED APPLICATION

This application claims the benefit of U.S. Provisional Application No. 61/608,914, filed Mar. 9, 2012, which is incorporated herein by reference.

FIELD OF THE INVENTION

The present invention relates generally to seats, and more particularly relates to seats of portable, collapsible type particularly adapted for use on flat and level supporting surfaces, such as stadium bleachers or benches.

BACKGROUND OF THE INVENTION

Lightweight, portable seats and chairs of a type with which the present invention is concerned are enjoying increasing popularity for use in viewing sports activities, concerts and a wide variety of other outdoor activities such as camping, boating, hunting, fishing and the like, normally lacking adequate preexisting seating accommodations. Such lightweight, portable seats are also desired for use in arenas and stadiums, where typically sit on preexisting bleachers or benches. However, such preexisting seating accommodations often lack sufficient back support for spectators.

Folding chairs are currently available in a wide variety of designs, but generally lack the desired degree of portability for ideal usage. Such folding chairs are especially unsuited for use in arenas and stadiums, where the chairs cannot fit over or around the preexisting bleachers or benches.

Lightweight portable seats are currently available on the market for use on stadium bleachers and benches, but are often difficult to set-up and break down, do not collapse to sufficient small size for transport and storage, and often do not have suitable back support, thereby offering little improvement over the preexisting bleacher or bench. Commonly, such seats comprise just a padded cushion that provides more comfort than a solid bleacher or bench. However, lightweight portable seats that do not have suitable back support, such as padded cushions, are consequently uncomfortable when used for a prolonged period of time.

In view of the foregoing, there is a need for a lightweight, portable seat that can be easily collapsed into a small bundle for transport and storage, and as easily set-up for use as a seat. There is also a need for such a seat that provides sufficient back support for a user, especially in a situation where preexisting seating accommodations either don't exist, or do not provide any back support for a seated spectator.

Accordingly, it is the general aim of the present invention to provide an improved, lightweight, portable, and collapsible seat intended for use on a level surface, such as a stadium bleacher or a bench, which provides back support for a user, and which further is easily collapsible into and retained in a compact bundle for transport and storage. It is a further aim of the present invention to provide a seat having a back support and arms that do not affect or interfere with the collapsing of the seat to a bundled condition or the set-up of the seat into an open, set-up condition, and which further do not compromise the size of the bundled condition of the seat for transport and storage.

SUMMARY OF THE INVENTION

In accordance with embodiments of the present invention, a collapsible stadium seat generally comprises a seat bottom, a back support, and two armrests, all interconnected for movement between an operative, or set-up, condition and a collapsed, or bundled, condition. The seat further includes an attachment strap for securing a set-up seat to a bleacher or bench, and a carrying strap or handle for transporting a collapsed and bundled seat, for example, over the user's shoulder or via a hand grasp.

In a first aspect of the present invention, a portable and collapsible seat having set-up and collapsed conditions comprises a seat bottom and a back support. The seat bottom comprises a first portion and a second portion being interconnected together and foldable into generally parallel relationship with one another associated with the collapsed condition of the seat. The seat bottom portions are generally adjacently disposed in a common plane when the seat is in its set-up condition. The back support is pivotally disposed relative to the seat bottom such that, in the set-up condition of the seat, the back support extends generally upwardly from a rear portion of the seat bottom and is capable of pivotal movement relative to the seat bottom for collapsing the seat to its collapsed condition.

In preferred embodiments of the present invention, the back support is pivotable relative to the seat bottom so that it is disposed in general parallel relationship with the seat bottom in its set-up condition prior to the first and second seat bottom portions being folded together to collapsed the seat to its collapsed condition where the seat bottom portions are disposed in generally parallel relationship. When the seat is collapsed, the back support is foldable with the seat bottom so that it is disposed in the collapsed condition of the seat wither within the seat bottom—i.e., between the first and second seat bottom portions when folded together—or around the folded seat bottom.

In preferred embodiments of the present invention, the back support comprises a frame and a fabric panel that is held taut by the frame in the operational and set-up condition of the seat, and which collapses when the seat is broken down to its bundled condition. In more preferred embodiments, the back support frame comprises vertical frame members that extend vertically from the armrests of the seat. In such embodiments, the fabric panel extends between the vertical frame members to define a back support that a user can lean back on for support.

In preferred embodiments of the present invention, the seat bottom comprises a padded seat cushion providing a user with sufficient comfort when sitting on a set-up seat. In more preferred embodiments, the seat bottom comprises multiple portions that fold together during the collapsing process of the seat so as to reduce the size of the bundled seat for transport and storage. Still further, the seat bottom portions are preferably connected by a fold, such as a fabric connector, extending along a common edge between said seat bottom portions.

In a second aspect of the present invention, a portable and collapsible seat having set-up and collapsed conditions comprises a seat bottom, a first armrest and a second armrest. The seat bottom comprises a first portion and a second portion being interconnected together and foldable into generally parallel relationship with one another associated with the collapsed condition of the seat. The seat bottom portions are generally adjacently disposed in a common plane when the seat is in its set-up condition. The first and second armrests are located on the outer edges of the seat bottom when said seat is in its set-up condition and said seat bottom portions are generally adjacently disposed in a common plane. The first and second armrests are pivotally connected with the first and second seat bottom portions, respectively, for movement relative thereto during set-up and collapsing of said seat.

In preferred embodiments of the present invention, the armrests pivot with folding movement of the seat bottom to a collapsed condition where the first armrest, the second armrest, the first seat bottom portion, and the second seat bottom portion are all generally disposed is parallel relationship with one another. A back support can pivotally extend from the armrests to define a surface against which a user may lean in the set-up condition of the seat, and which can be pivoted relative to the seat bottom and the armrests for collapsing the seat to its collapsed condition, where the back support is preferably folded with the seat bottom portions and the armrests.

The seat of the present invention may further include add-on features, such as a beverage holder and a storage pocket, that help to enhance the spectator's experience while using the seat.

These and other objects, features and advantages of the present invention will become apparent in light of the detailed description of embodiments thereof, as illustrated in the accompanying drawings.

DETAILED DESCRIPTION OF PREFERRED EMBODIMENTS

Figure 1:
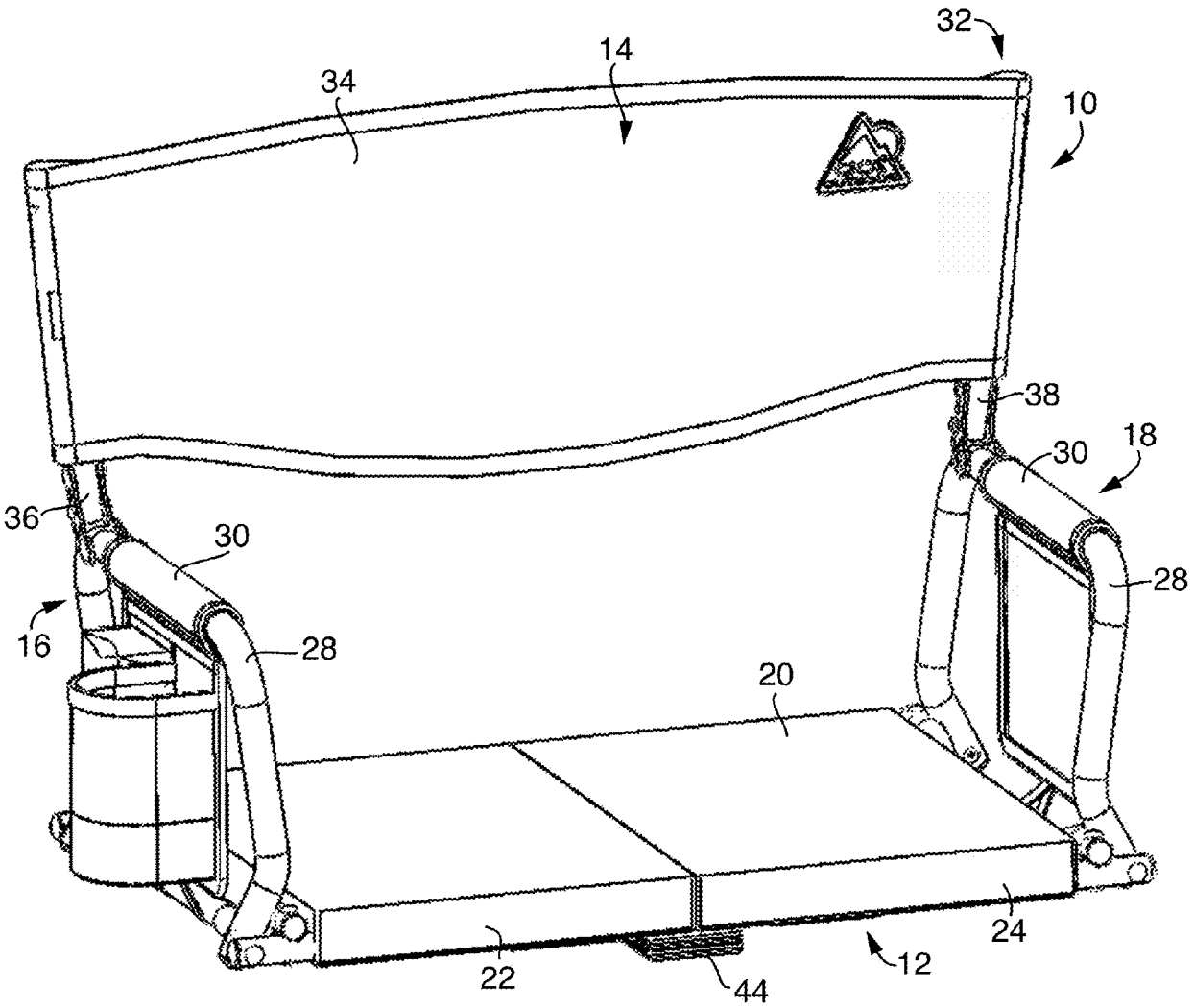
FIG. 1 is a perspective view of a portable and collapsible seat in accordance with an embodiment of the present invention shown in a set-up condition.
Figure 2:
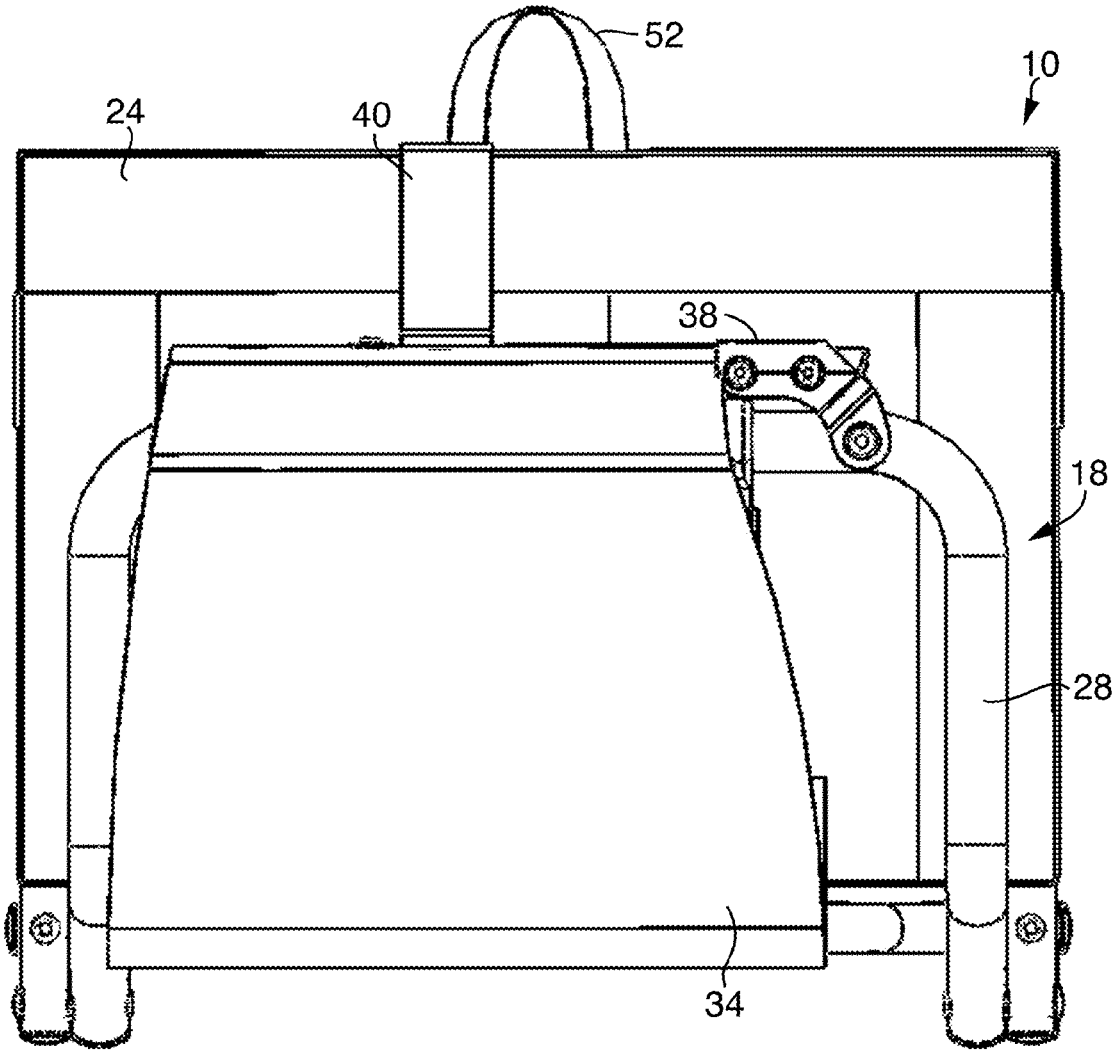
FIG. 2 is a planar side view of the portable and collapsible seat of FIG. 1 shown in a collapsed and bundled condition and capable of being carried by a user via a carrying strap.
Figure 3:
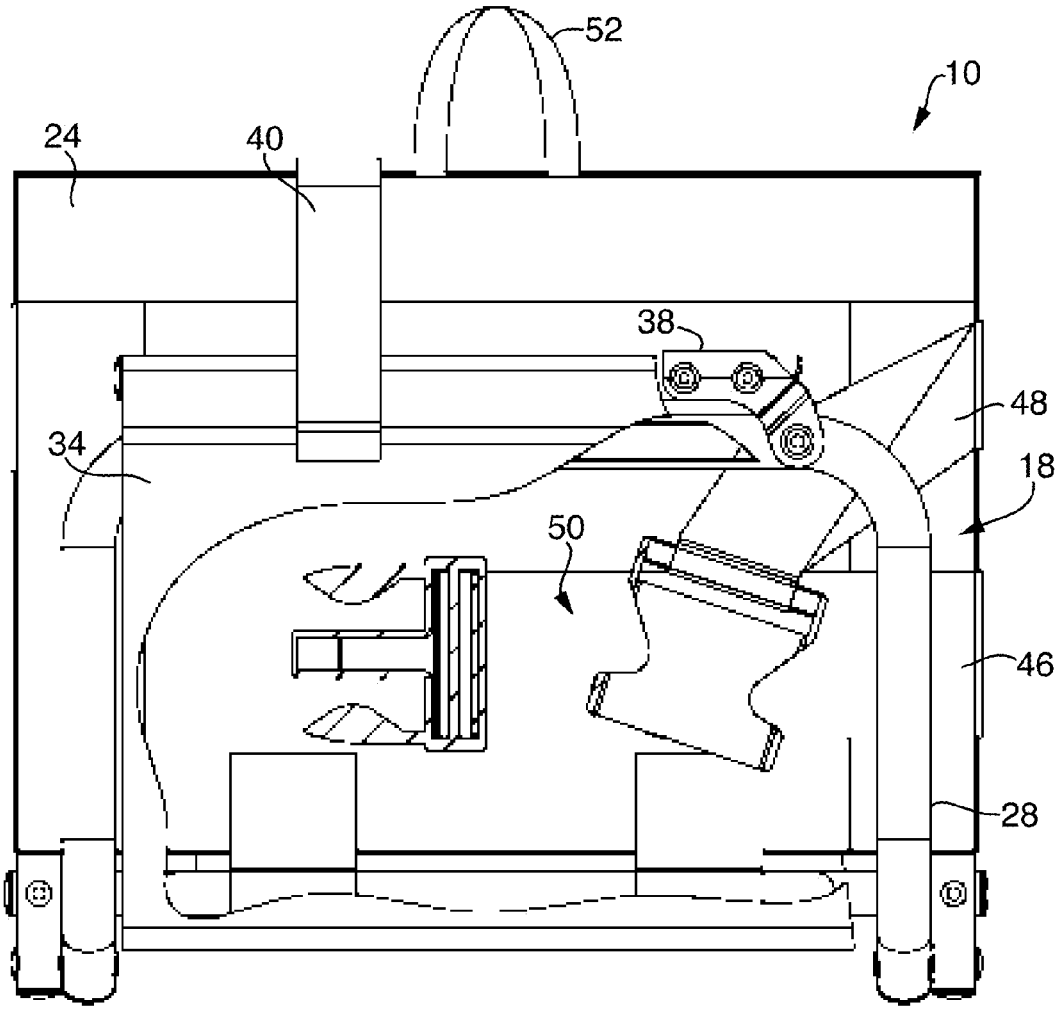
FIG. 3 is a planar partial side view of the portable and collapsible seat of FIG. 1 shown in the collapsed and bundled condition.

Turning now to the drawings, a portable and collapsible seat embodying the present invention, and generally designated by reference numeral 10, is shown in FIG. 1 in its operative, or set-up, condition and in FIGS. 2-3 in its collapsed, or bundled, condition. The seat 10 is especially suitable for use in arenas and stadiums for spectator events, such as sporting events and concerts, where preexisting seating accommodations typically comprise level surfaces, such as bleachers and benches, that are hard and have little or no back support. Still further, the seat 10 can be used on other level surfaces, such as the ground or a floor, to provide a seat with sufficient back support for enjoying a variety of spectator events, such as sporting events, concerts, and fireworks displays, and a variety of other activities such as camping, boating, hunting, fishing and the like, where such events and activities normally lack any adequate preexisting seating accommodations.

As shown in FIG. 1, the seat 10, when set-up, may sit atop the preexisting seating surface (e.g., a stadium bleacher), and defines a seat or chair for the user that preferably provides a comfortable seating bottom seating surface 12, a back support 14, and two armrests 16 and 18. These components of the seat 10 are interconnected to be easily and simply collapsed into a collapsed and bundled condition, such as shown in FIGS. 2-3, for transport and storage. The interconnection of the seat components further facilitates easy and simple set-up of the seat for use, as illustrated in the successive steps illustrated in FIGS. 4-8.

Figure 5:
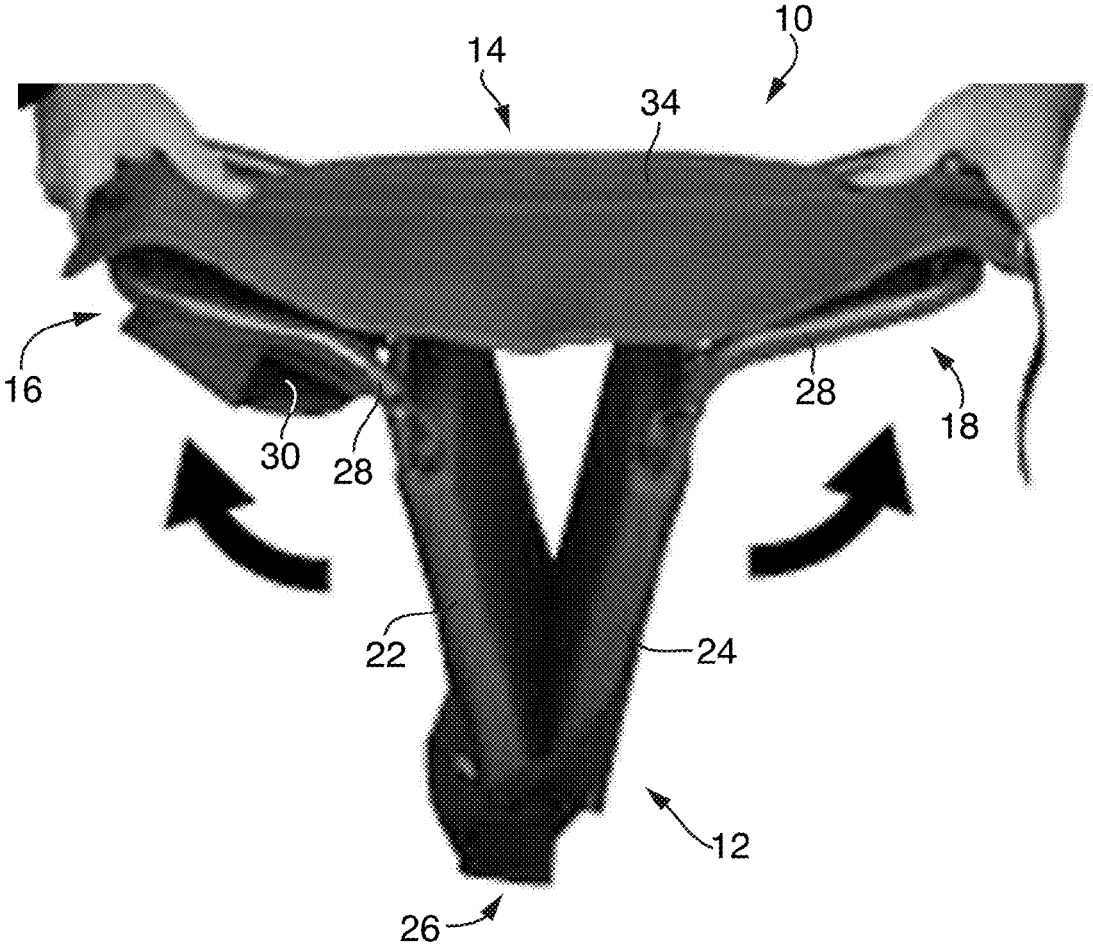

As shown in FIG. 1, the seat 10 generally comprises a seat bottom 12 that preferably comprises a padded seat cushion 20 divided into two portions 22 and 24. Each seat bottom portion 22 and 24 is covered by a fabric material that is preferably durable and waterproof. The portions 22 and 24 are further interconnected together so that they can be folded together into generally parallel relationship to one another, much like a book, when the seat 10 is collapsed, and unfolded to define a singular, planar seating surface when the seat 10 is in its set-up condition. As shown, when the seat 10 is in its set-up condition, the first and second seat bottom portions 22 and 24 are generally adjacently disposed in a common plane. As shown in FIG. 5, a fabric connector 26 may hold the seat bottom portions 22 and 24 together, for example, along a common edge between the seat portions 22 and 24, while facilitating folding of the portions 22 and 24 together without affecting their relative alignment for set-up.

Figure 10:
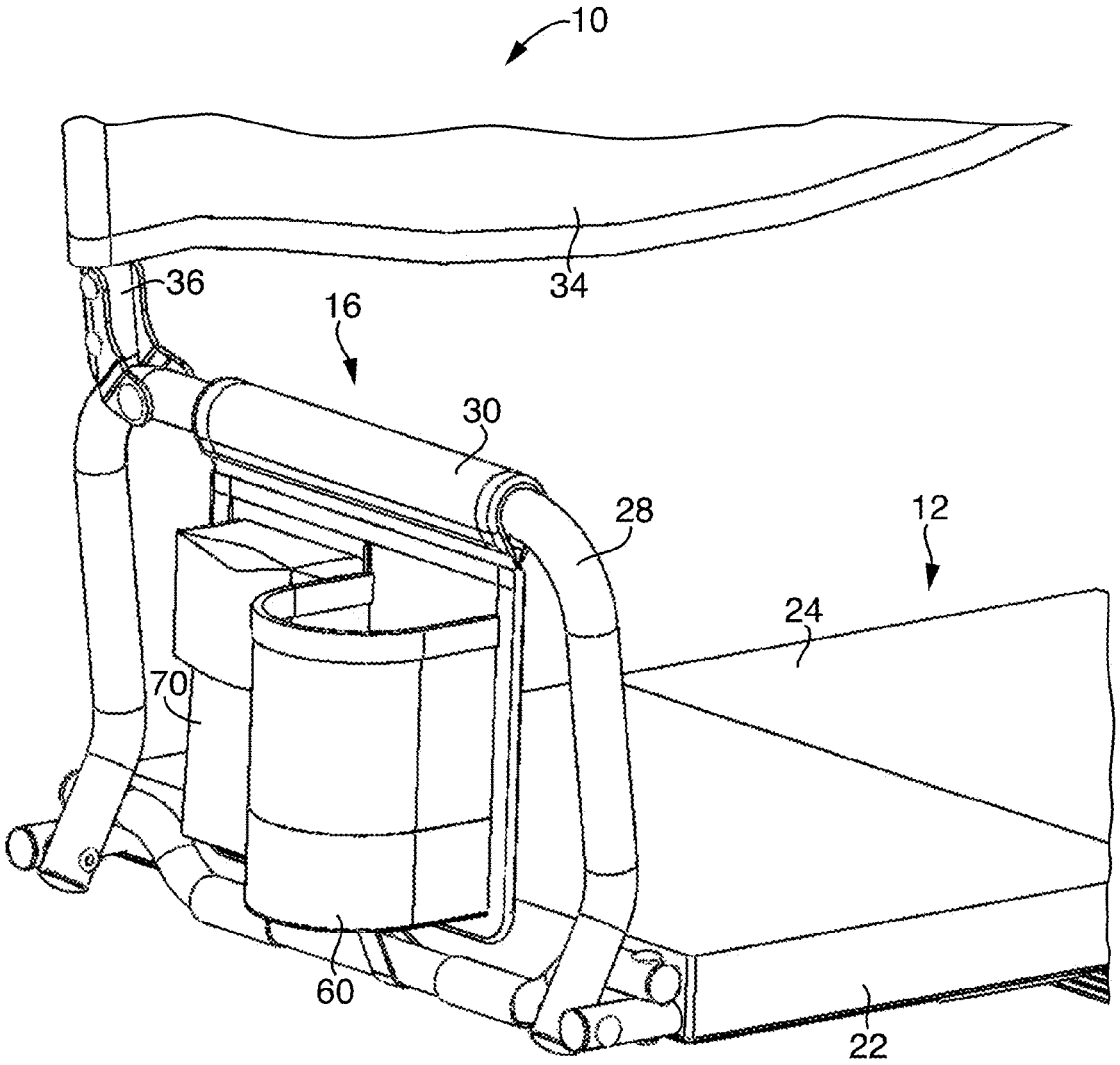
FIG. 10 shows a partial perspective view of an embodiment of the portable and collapsible seat of FIG. 1 illustrating examples of add-on features for the seat to enhance the user's experience while using the seat in its set-up condition.

As further shown in FIG. 1, the seat 10 comprises two armrests 16 and 18 pivotally connected to the seat bottom surface 12 for movement relative thereto. Preferably, each armrest 16 and 18 is pivotally connected to the seat bottom 12 at two locations, namely, the front and back along a side edge thereof. Each armrest 16 and 18 generally comprises a tubular frame 28 to define a support for a user's arms when seated in the set-up seat 10. The tubular frame 28 may further include a fabric and/or padded cover 30 to increase the comfort of the seated user. As further illustrated in FIG. 10, add-on features may be provided on the armrests, such as, for example, a beverage holder 60 and a storage pocket 70 provided on a fabric panel 30 attached to the armrest frame 28.

The back support 14 of the seat 10 is pivotally disposed relative to the seat bottom 12. In the set-up condition of the seat 10, the back support 14 extends generally upwardly from a rear portion or edge of the seat bottom 12 and is capable of pivotal movement relative to the seat bottom 12 for collapsing the seat 10 to its collapsed condition.

The back support 14 generally comprises a frame 32 and a flexible fabric panel 34 mounted on the frame 32. As shown in FIG. 1, the back support frame 32 comprises two vertical frame members 36 and 38 vertically extended up from the rear of the armrests 16 and 18, respectively, with the fabric panel 34 extending between the frame members 36 and 38 to define a support surface for the user's back against which the user may lean in the set-up condition of the seat 10. When the seat 10 is in its set-up condition, as shown in FIG. 1, the fabric panel 34 is held generally taut between the vertical frame members 36 and 38. When the seat 10 is collapsed to its bundled condition, such as via the process as illustrated in FIGS. 4-7, in reverse, the fabric panel 34 collapses with the seat 10, and may act as an outer wrap for the bundled seat 10 that keeps the seat components folded together. In this regard, the back support fabric panel 34 may include a release closure strap 40 to keep seat 10 in its collapsed and bundled condition for transport and storage, as illustrated in FIGS. 2-3. For example, this release closure strap 40 may comprise hook-and-loop fastening means, which are secured when the seat 10 is in its bundled condition, and which can be released so that the user can set up the seat 10 for use. Alternately, the back support 14 may be folded within the folded seat bottom portions 22 and 24 so as to be disposed between such portions 22 and 24 when the seat 10 is collapsed.

The back support frame 32 is preferable pivotally attached to the armrests 16 and 18 such that the back support 14 can be pivoted down toward the armrests 16 and 18 so that the back support fabric panel 34 is generally horizontally disposed during the collapsing process of the seat 10, and likewise pivoted up from the armrests 16 and 18 so that the back support fabric panel 34 is generally vertically disposed during the set-up process of the seat 10.

Referring to FIGS. 4-8, successive steps to be performed in setting up the seat 10 are illustrated. Consequently, the collapsing process of the seat 10 is likewise illustrated by reversing the steps shown in these figures.

Figure 4:
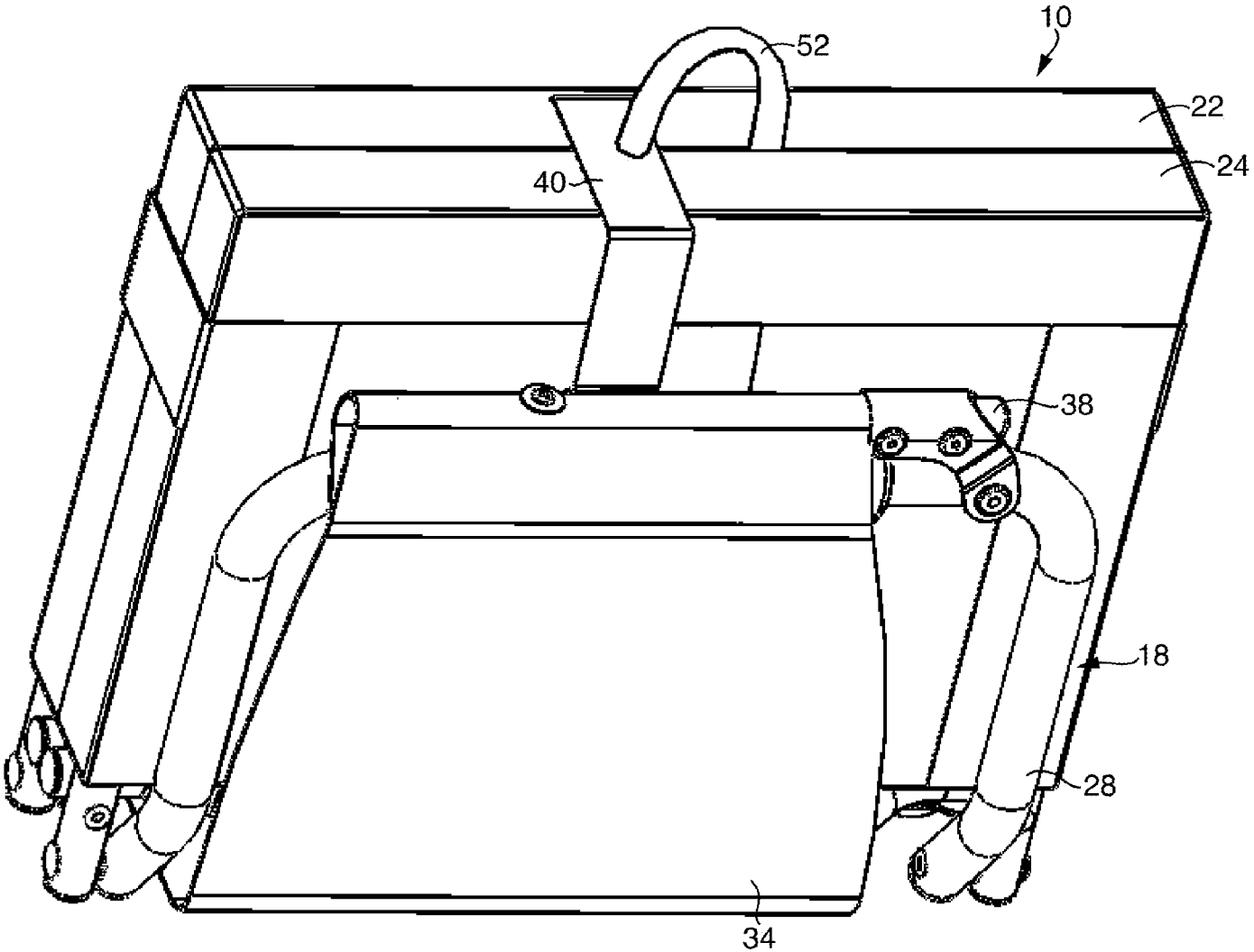
FIGS. 4-8 illustrate steps for unfolding and setting up the portable and collapsible seat of FIG. 1 from its bundled condition to its set-up condition for intended use.
Figure 7:
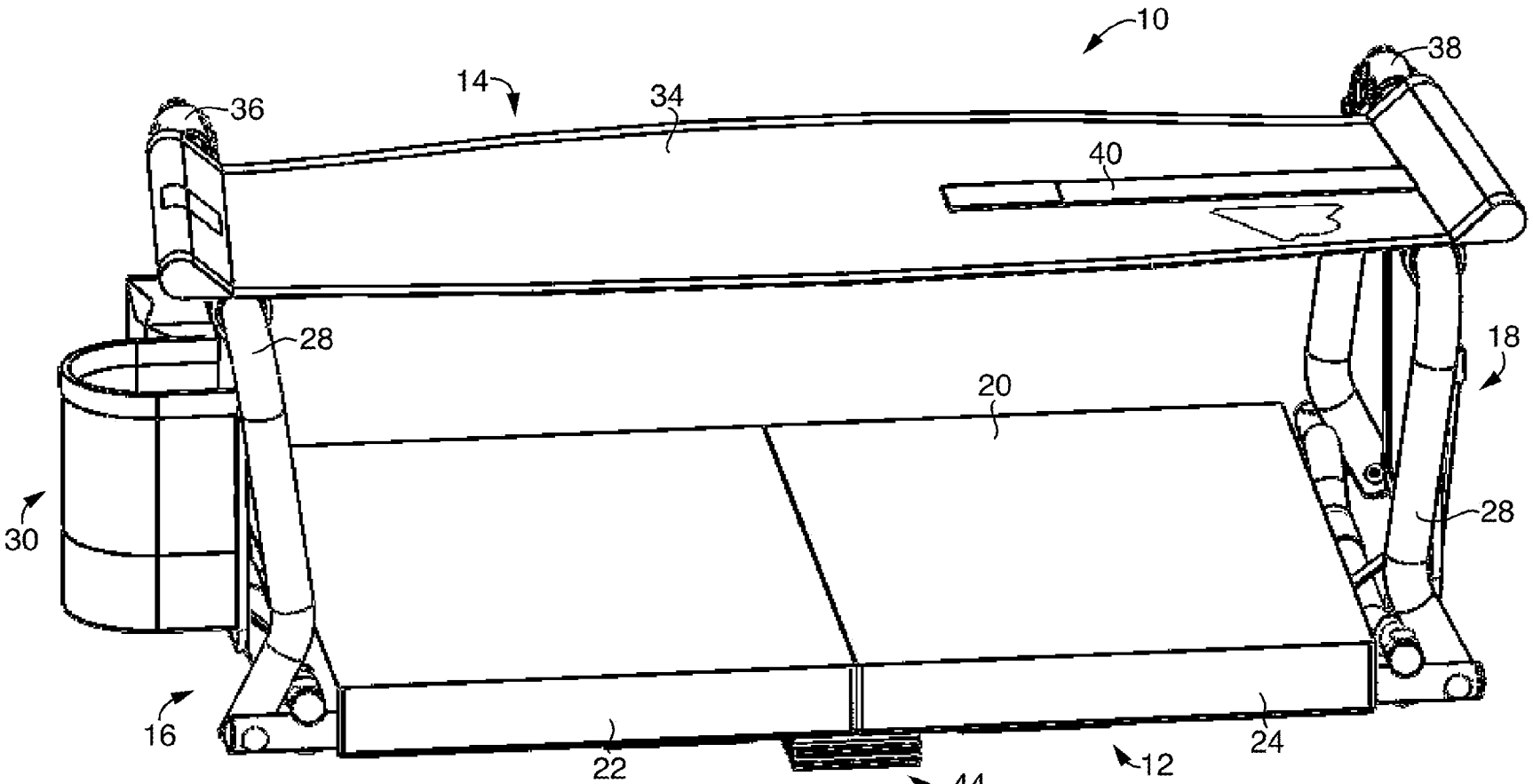

In FIG. 4, the seat 10 is shown in a bundled condition. As noted above, the seat 10 is maintained in this bundled condition by the release closure strap 40 provided on the seat 10. To commence the set-up process, the release closure strap 40 is disengaged, for example, by separating hook-and-fastener means. As shown in FIG. 4, a first end of the release closure strap 40 is disengaged from the bottom side of the first seat bottom portion 22. Preferably, the second end of the release strap 40 is attached to the back support fabric panel 34, as illustrated in FIGS. 3 and 7, although the strap 40 may also be attached to the second seat bottom portion 24 at its second end. Preferably, the release strap 40 remains connected to the fabric panel 34 after it is released, as shown in FIG. 7, while a corresponding attachment mechanism 42 (e.g., a hook-and-fastener strip) remains attached to the first seat bottom portion 22, as shown in FIG. 5.

Figure 6:
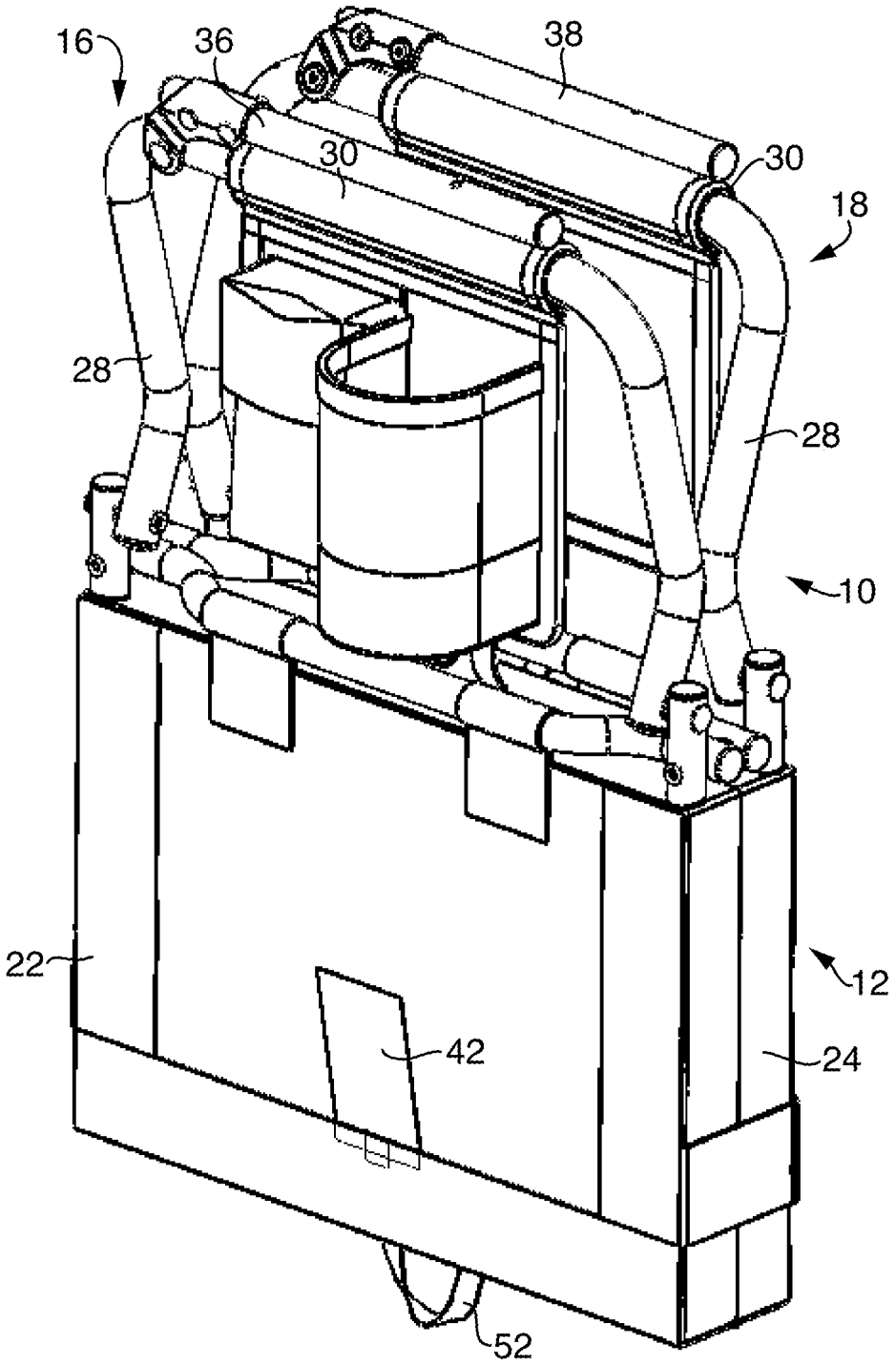

In FIG. 5, the armrests 16 and 18 are rotated upwardly away from the folded seat bottom portions 22 and 24, which remain in folded relationship to another. As shown, each armrest 16 and 18 is brought around a respective side of the folded seat bottom 12 along the paths indicated by the arrows in FIG. 5, until they come together in parallel relationship to one another, as shown in FIG. 6. In this position, each armrest 16 and 18 generally forms a planar extension of a respective seat bottom portion 22 and 24. During this unfolded step, the back support frame members 36 and 38 stay folded against a respective armrest 16 and 18. In the condition shown in FIG. 6, the back support fabric panel 34 is folded between the upwardly extending armrests 16 and 18.

In the next step, starting from the condition shown in FIG. 6, the armrests 16 and 18 are pulled laterally away from one another along the path of the illustrated arrows. With this motion, the seat bottom portions 22 and 24 are unfolded into a singular, planar condition and placed on a level surface, such as a stadium bleacher or bench. As this stage, the armrests 16 and 18 are positioned in a pivotally open condition at the left and right edges of the seat bottom 12 in generally parallel relation to one another. The back support 14 is held in a position where it is folded down on top of the armrests 16 and 18 with the fabric panel 34 held taut between the back support frame members 36 and 38 in a generally horizontal condition, as illustrated.

Figure 8:
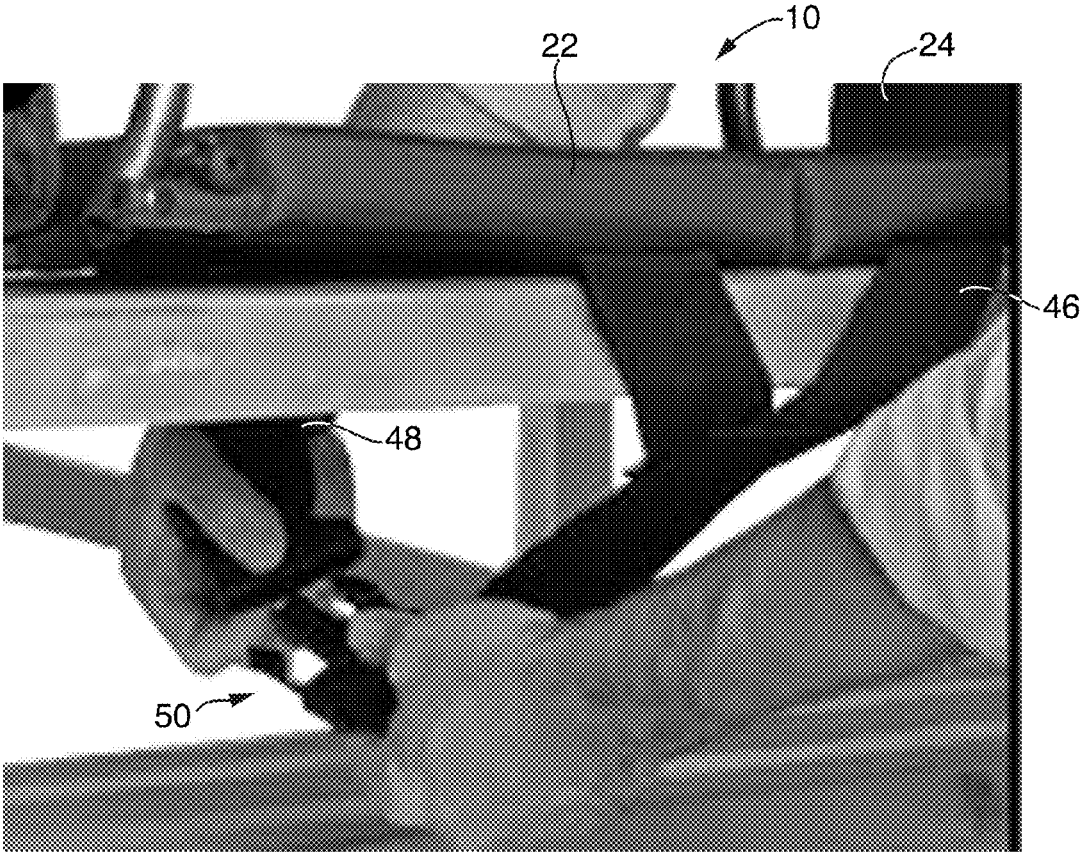
Figure 9:
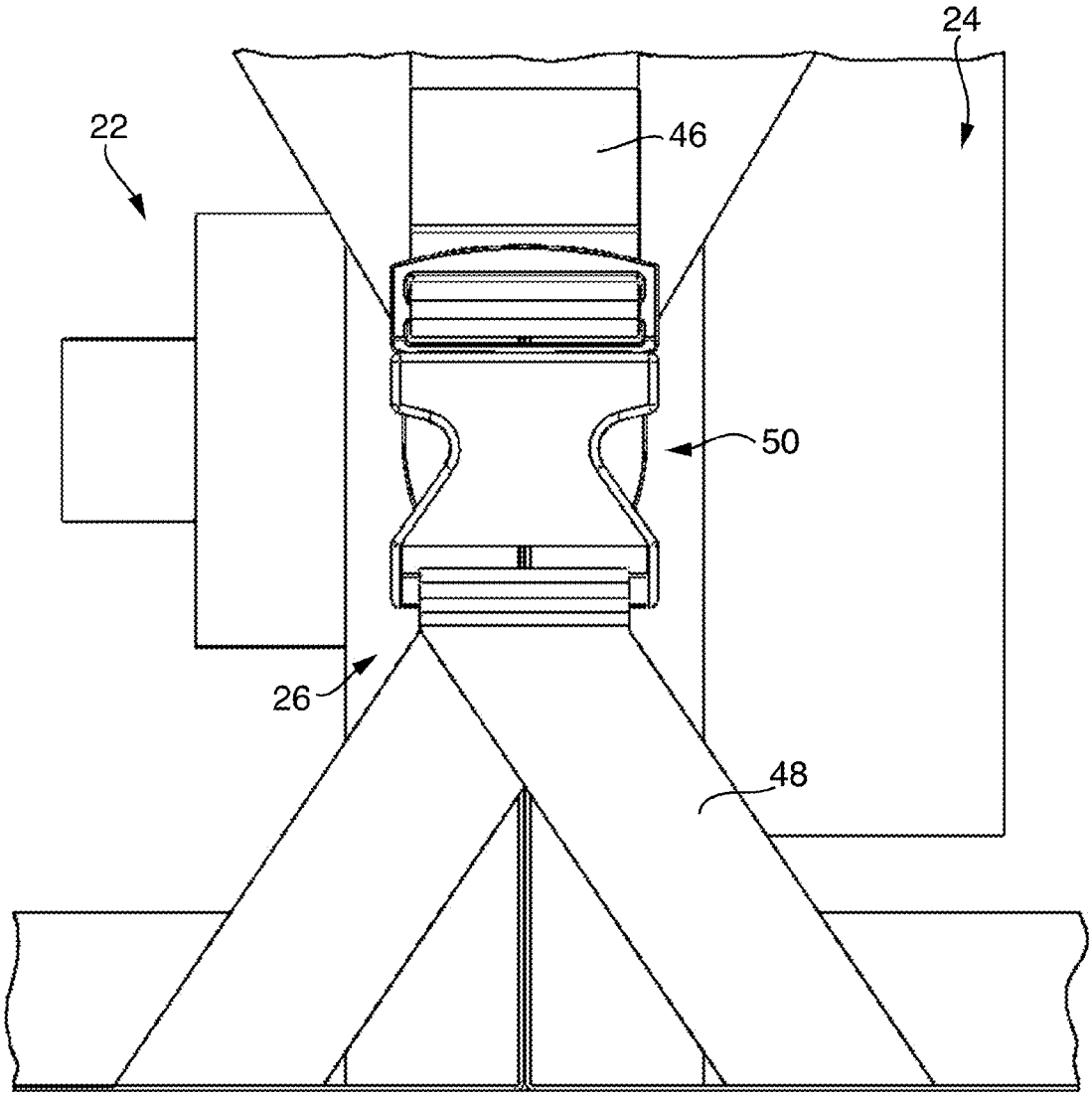
FIG. 9 shows a planar bottom view of the portable and collapsible seat of FIG. 1, illustrating an embodiment of an attachment strap used to secure the portable and collapsible seat to a stadium bleacher or bench while in its set-up condition in accordance with the present invention.

As shown in FIG. 7, the next set-up step is to pivot the back support 14 along the path illustrated by the arrows to its upright and generally vertical condition. With this step, the seat 10 is generally in its set-up condition. The last step, as shown in FIG. 8, is to secure the seat 10 to the bleacher or bench using an attachment strap system 44 connected to the seat bottom 12. As further illustrated in FIG. 9, the attachment strap system 44 may comprise straps attached to each seat bottom portion 22 and 24 at the front and back thereof, which join together into a single front strap 46 and a single back strap 48 that can be connected together around the bleacher or bench using a common fastener means, such as the illustrated buckle 50. In accordance with the present invention, the attachment strap system 44 can be adjustable to accommodate bleachers and benches of varying size so as to ensure that the set-up seat 10 is held in place on such a level surface in a secure and stable manner. When the seat 10 is collapsed, the straps 46 and 48 and the fastener means 50 are preferably stored within the bundled seat 10, such as illustrated in FIG. 3, where the fabric panel 34 has been partial removed to show how the seat components are bundled, and preferably wrapped into the back support 14. Alternatively, the attachment strap system 44 may be used as a carrying strap or handle to facilitate transportation of the seat 10 in its collapsed condition.

To collapse the seat 10 to its bundled condition, the steps illustrated in FIGS. 4-8 are simply reversed. For examples, the directional paths of the arrows shown in each of FIGS. 5-7 can be reversed for the collapsing process. Before folding any parts of the seat 10, the attachment strap system 44 must be disengaged so that the seat 10 is no longer secured to the bleacher or bench on which it is resting. Next, the back support 14 is pivoted down so that the back support panel 34 is generally horizontally disposed, and the frame members 36 and 38 are adjacent the tops of the armrests 16 and 18, respectively, as shown in FIG. 7. In this condition, the armrests 16 and 18 are pushed laterally inward toward each other, causing the seat bottom portions 22 and 24 to fold together, as shown in FIG. 6. As a result, the armrests 16 and 18 and the folded together seat bottom portions 22 and 24 are all generally parallel, with the armrests 16 and 18 essentially forming planar extensions of their respective seat bottom portions 22 and 24. Next, the armrests 16 and 18 are pivoted down around each side of the folded seat bottom 12 until they are generally adjacent to and parallelly disposed relative to the seat bottom portions 22 and 24, as shown in FIGS. 4 and 5. Referring to FIG. 4, the back support fabric panel 34 will preferably wrap around the entire bundled seat 10, which can be held in this condition using the release closure strap 40.

Referring back to FIG. 2, the seat 10 further comprises a carrying strap or handle 52 that helps the user to carry the bundled and collapsed seat 10.

Though preferred embodiments of the present invention utilize two armrests, a seat in accordance with the present invention can be provided with just a seat bottom surface and a back support without departing from the spirit and principles of the present invention. In such an alternate embodiment, the back support frame may be pivotally connected directly to the seat bottom surface, such that the back support is pivotally folded together with the seat bottom surface during the collapsing process of the seat, and pivotally separated from one another during the set-up process of the seat.

Additionally, though preferred embodiments of the present invention utilize a back support, a seat in accordance with the present invention can be provided with just a seat bottom surface and armrests without departing from the spirit and principles of the present invention. In such an alternate embodiment, the seat would be set-up, and collapsed, essentially in accordance with the steps illustrated in FIGS. 4-6.

The foregoing description of embodiments of the present invention has been presented for the purpose of illustration and description. It is not intended to be exhaustive or to limit the invention to the form disclosed. Obvious modifications and variations are possible in light of the above disclosure. The embodiments described were chosen to best illustrate the principles of the invention and practical applications thereof to enable one of ordinary skill in the art to utilize the invention in various embodiments and with various modifications as suited to the particular use contemplated.

What is claimed is:

1. A portable and collapsible seat having set-up and collapsed conditions and comprising:

a seat bottom comprising a first portion and a second portion, said portions being interconnected together and foldable into generally parallel relationship against one another associated with the collapsed condition of the seat and a folded condition of said seat bottom, and wherein said portions are generally adjacently disposed in a common plane when said seat bottom is in an unfolded condition;

a back support pivotally disposed relative to the seat bottom, said back support in said set-up condition of said seat extending generally upwardly from a rear portion of the seat bottom and in the collapsed condition of said seat being adjacent the first and second portions of the seat bottom in the folded condition of the seat bottom; and a first armrest and a second armrest that protrude generally orthogonally from the seat bottom when the seat bottom is unfolded, wherein said first and second armrests are pivotally connected at outward edges of the respective first and second portions of the seat bottom and are constrained to fold toward each other as the seat bottom is moved from its unfolded condition to its folded condition.

2. The portable and collapsible seat according to claim 1, wherein said back support is capable of being pivoted relative to the seat bottom so that said back support is disposed in a generally parallel relationship with the seat bottom in its unfolded condition prior to the first and second portions of the seat bottom being folded together to collapse the seat to its collapsed condition in which the first and second portions of the seat bottom are disposed in generally parallel relationship with each other and with the back support.

3. The portable and collapsible seat according to claim 2, wherein the back support, after being pivoted relative to the seat bottom so that the back support is disposed in general parallel relationship with the seat bottom in its unfolded condition, is foldable with the seat bottom so that the back support is disposed in its folded condition either between the first and second portions of the seat bottom or around the first and second portions of the seat bottom, and in generally parallel relationship with said seat bottom portions after they are folded together.

4. The portable and collapsible seat according to claim 1, wherein the back support is pivotally connected to a rear portion of each of the first and second armrests.

5. The portable and collapsible seat according to claim 4, wherein the back support is capable of pivotal movement relative to the first and second armrests to a position generally parallel to the seat bottom in the unfolded condition of the seat bottom, and wherein said first and second armrests pivot with folding movement of the seat bottom to a collapsed condition where the first armrest, the second armrest, the first seat bottom portion and the second seat bottom portion are all generally disposed in parallel relationship with one another.

6. The portable and collapsible seat according to claim 5, wherein in the collapsed condition of the seat, the back support is generally disposed in parallel relationship to the first and second portions of the seat bottom and the first and second armrests.

7. The portable and collapsible seat according to claim 4, wherein the back support comprises:

a first back support member pivotally extending from the first armrest;

a second back support member pivotally extending from the second armrest; and a fabric panel extending between the first and second back support members to define a surface against which a user may lean in the set-up condition of the seat.

8. The portable and collapsible seat according to claim 7, wherein the fabric panel is generally taut in the set-up condition of the seat, and is foldable with the first and second seat bottom portions and the first and second armrests during movement of the seat to its collapsed condition.

9. The portable and collapsible seat according to claim 8, wherein, in the collapsed condition of the seat, the fabric panel is folded around the collapsed seat bottom and first and second armrests.

10. The portable and collapsible seat according to claim 1, wherein the first and second seat bottom portions are foldably connected by a fabric strip extending along a common edge between said seat bottom portions.

11. A portable and collapsible seat having set-up and collapsed conditions and comprising:

a seat bottom comprising a first portion and a second portion, said portions being interconnected together and foldable into generally parallel relationship to one another associated with a folded condition of the seat bottom and the collapsed condition of the seat, and wherein said portions are generally adjacently disposed in a common plane when the seat bottom is in an unfolded condition; and a first armrest and a second armrest that protrude generally orthogonally from the seat bottom when said seat is in its set-up condition and the seat bottom is unfolded, said first and second armrests being pivotally connected with the first and second portions of the seat bottom, respectively, for folding movement toward each other during collapsing of said seat.

12. The portable and collapsible seat according to claim 11, wherein said first and second armrests pivot with folding movement of the seat bottom to a collapsed condition where the first armrest, the second armrest, the first seat bottom portion and the second seat bottom portion are all generally disposed in parallel relationship with one another.

13. The portable and collapsible seat according to claim 12, further comprising a back support pivotally connected to a rear portion of each of the first and second armrests, said back support in said set-up condition of the seat extending generally upwardly relative to a rear edge of said seat bottom and being capable of pivotal movement toward said first and second armrests for collapsing said seat to its collapsed condition.

14. The portable and collapsible seat according to claim 13, wherein the back support comprises:

a first back support member pivotally extending from the first armrest;

a second back support member pivotally extending from the second armrest; and a fabric panel extending between the first and second back support members to define a surface against which a user may lean in the set-up condition of the seat.

15. The portable and collapsible seat according to claim 14, wherein the fabric panel is generally taut in the set-up condition of the seat, and is foldable with the first and second seat bottom portions and the first and second armrests during movement of the seat to its collapsed condition.

16. The portable and collapsible seat according to claim 15, wherein, in the collapsed condition of the seat, the fabric panel is folded around the collapsed seat bottom and first and second armrests.

17. The portable and collapsible seat according to claim 14 wherein the first and second back support members are pivotal relative to the respective first and second armrests from the set-up condition of the seat to a folded condition of the back support in which the first and second back support members are parallel to and spaced apart from the seat bottom in its unfolded condition, and from which the first and second back support members move together with the armrests as the seat bottom is folded to the collapsed condition of the seat.

18. The portable and collapsible seat according to claim 11, further comprising a back support that extends generally orthogonal to the seat bottom in the set-up condition of the seat, wherein said back support is pivotally disposed relative to the seat bottom and is capable of being pivoted relative to the seat bottom so that said back support is disposed in a generally parallel relationship with the seat bottom in the unfolded condition of the seat bottom prior to the first and second portions of the seat bottom being folded together to collapse the seat to its collapsed condition.

19. A portable and collapsible seat having set-up and collapsed conditions and comprising:

a seat bottom that comprises a first portion and a second portion and a fabric strip connecting mutually facing edges of the first and second portions, wherein said portions of the seat bottom are generally adjacently disposed along a common plane when the seat bottom is in an unfolded condition, and are foldably connected by said fabric strip so that said portions are foldable from the unfolded condition of the seat bottom to a generally parallel relationship at opposite sides of a common plane in the collapsed condition of the seat;

a first armrest and a second armrest that protrude generally orthogonally from the seat bottom when said seat is in its set-up condition, wherein said first and second armrests are generally rigid and are pivotally connected with respective ones of the first and second portions of the seat bottom for movement toward each other from the set-up condition of the seat to positions generally parallel with the respective portions of the seat bottom in the collapsed condition of the seat; and a back support that comprises a fabric panel connected between first and second back support members, wherein each back support member is pivotally connected to a respective one of the first and second armrests for movement from a position generally orthogonal to said seat bottom in said set-up condition of the seat, to a position generally parallel and spaced apart from said seat bottom in a folded condition of said back support, and in said folded condition of said back support each back support member rests against and is pivotally movable with the respective armrest to the collapsed condition of the seat.

20. The portable and collapsible seat according to claim 19 wherein the fabric panel is generally taut in the set-up condition of the seat, and is foldable from the folded condition of the back support, during movement of the seat to its collapsed condition, in order to be wrapped around the first and second portions of the seat bottom and the first and second armrests in the collapsed condition of the seat.

* * * * *